United States Patent [19]

Jonsson

[11] Patent Number: 4,565,084

[45] Date of Patent: Jan. 21, 1986

[54] METHOD AND A TOOL FOR BENDING THE EDGE OF THICK SHEET METAL

[75] Inventor: Finn Jonsson, Ystad, Sweden

[73] Assignee: ASEA Aktiebolag, Västerås, Sweden

[21] Appl. No.: 550,467

[22] Filed: Nov. 10, 1983

[30] Foreign Application Priority Data

Nov. 12, 1982 [SE] Sweden ..... 8206438

[51] Int. Cl.[4] ..... B21J 13/00

[52] U.S. Cl. ..... 72/387; 72/447

[58] Field of Search ..... 72/387, 308, 310, 446, 72/447, 210, 306, 388

[56] References Cited

U.S. PATENT DOCUMENTS 2,178,926 11/1939 Brickman et al. ..... 72/447

4,092,840 6/1978 Eckold et al. ..... 72/312

FOREIGN PATENT DOCUMENTS 2455596 9/1977 Fed. Rep. of Germany .

*Primary Examiner*—Lowell A. Larson

*Assistant Examiner*—Linda McLaughlin

*Attorney, Agent, or Firm*—Watson, Cole, Grindle & Watson

[57] ABSTRACT

For bending the edge of a thick sheet of metal a tool comprising a yoke with a long and a short leg with plate-engaging bars in the opening between the legs is used. The tool is placed on a sheet so as to straddle the edge to be bent with one bar on each side of the sheet. An extensible member, for example a hydraulic cylinder, bears against the sheet to tilt the yoke so that the bars are pressed against the sheet to bend it. The tool may be provided with transport wheels and drive equipment for automatically moving the tool on the sheet.

10 Claims, 4 Drawing Figures

METHOD AND A TOOL FOR BENDING THE EDGE OF THICK SHEET METAL

BACKGROUND OF THE INVENTION

1. Field of the Invention

The invention relates to a method of curving an edge portion of a sheet of deformable material (e.g. metal) and to a bending tool for carrying out the method.

2. Description of the Prior Art

When shaping thick sheet metal (e.g. 20–200 mm thick) for cylindrical containers, each sheet is bent by rolling it or by successively bending it in a hydraulic press. In the latter case the sheet is supported on two spaced-apart elongated pads and is subjected to a press force from an elongated punch engaging the sheet at a location between the two pads. Using such a press arrangement or a conventional three-roll bending press, the edge portion(s) of the sheet cannot be given the desired curvature, but a plane edge portion having a width of at least twice the sheet thickness, and often more, remains. The difficulties are accentuated with increasing sheet thickness and are particularly great when the sheet thickness exceeds 70–80 mm. With known pre-bending methods for bending an edge portion, the sheet is subjected to such high specific pressure from the convex surfaces of pads or rolls, that permanent yielding of the sheet material may occur in the edge region. The risk of undesired deformation of the edge region of a sheet is particularly great during simultaneous sliding between the sheet and the outermost die bar. The drawback is particularly great if a sheet edge has been carefully machined in preparation for the forming of a weld joint.

OBJECTS OF THE INVENTION

One object of the invention is to effect edge bending of a sheet of deformable material using simpler and cheaper machine equipment than that hitherto available. A second object is to reduce the risks of the edge regions of a sheet being deformed in an undesired manner during bending. A still further object is to provide an easily transportable bending tool, which is not expensive to produce and which is easy to use.

SUMMARY OF THE INVENTION

According to the method of the invention, a sheet is placed on a table or other support so that the edge to be bent projects freely beyond the table. A bending tool with a J-shaped yoke with one longer leg and one shorter leg is slipped onto the free edge of the sheet in such a way that the yoke straddles that edge of the sheet and so that two elongated bars mounted in the yoke will be positioned one near the sheet edge on the upper side of the sheet and one near the sheet edge on the lower side of the sheet. One bar should be further away from the sheet edge than the other bar. The longer leg of the yoke of the bending tool is provided with an extensible operating device, suitably one or more hydraulic cylinders which act against the sheet, and using this device the tool is tilted relative to the table so that both bars are pressed against the sheet at different distances from the sheet edge, to cause a bending of the outermost part of the sheet projecting beyond the table. The tool may have the same width as the length of the sheet edge to be bent but normally the tool width will be much shorter than the length of the sheet since the latter may be very long, for example 10–15 m. The tool is displaced step-by-step along the sheet edge and bends a short part thereof for each step taken. The tool can traverse along the edge of the sheet several times increasing the degree of bending bit by bit until the required edge curvature is obtained.

A tool according to the invention having a J-shaped yoke would normally be used with the long leg positioned above the sheet to be bent, and the one short leg positioned below the sheet. Within that part which straddles the sheet edge, there are preferably two pads or tool bars, the upper one being nearer the end of the recess in the yoke than the lower one, thus obtaining a suitable lever arm from the bending operation. The lower pad or bar is suitably made to be displaceable relative to the end of the recess so that different distances between the pads or bars may be obtained and thereby lever arms of different length. The longer leg of the yoke may be provided with a cylinder, whose piston rod is adapted to be pressed against the upper side of the sheet and can thereby be used to tilt the yoke so that the pads or bars are pressed against the sheet and effect the bending of the sheet. The longer leg of the yoke may be provided with transport wheels to roll on the top of the sheet surface and guide rollers to roll along the sheet edge, enabling the tool to move easily over the sheet along the sheet edge to be bent. A device for moving it automatically over the sheet may be provided to simplify moving the tool in this manner along the edge to be bent.

BRIEF DESCRIPTION OF DRAWINGS

The invention will now be described in greater detail, by way of example, with reference to the accompanying drawings, in which.

DESCRIPTION OF PREFERRED EMBODIMENTS

Figure 1:
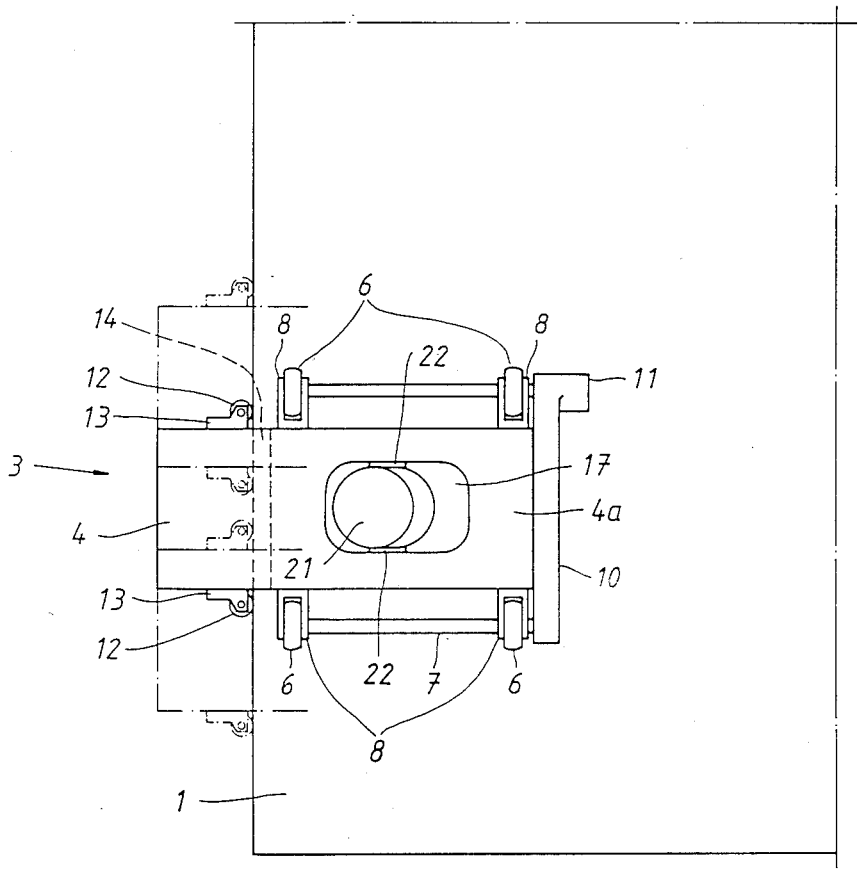
FIG. 1 is a plan view from above of an edge-bending tool in accordance with the invention shown mounted on an edge of a sheet to be bent.
Figure 2:
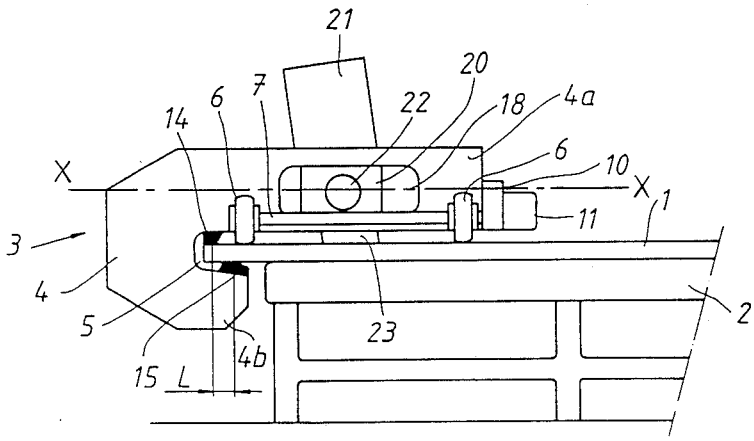
FIG. 2 is a side elevation of the tool of FIG. 1 showing how the sheet is resting on a support with the edge to be bent projecting thereover and how the projecting edge is straddled by a yoke of the tool.
Figure 3:
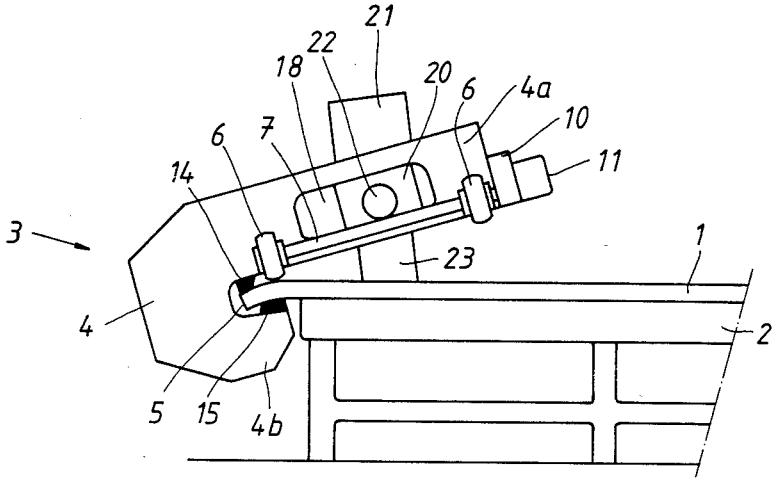
FIG. 3 shows a side elevation similar to FIG. 2 but with the tool engaged in a bending operation on the projecting sheet edge.

In the drawings, 1 designates a deformable sheet which is resting on a horizontal support table 2. A bending tool (generally designated 3) comprises a J-shaped, relatively wide yoke 4 having one long leg portion 4*a*, one short leg 4*b* portion, and an interconnecting base portion 4*c*, and between these portions a recess 5 is defined. An imaginary central plane X extends through the long leg portion 4*a*, in its elongated dimension. The tool 3 illustrated in FIGS. 1 to 3 is provided with two pairs of spaced-apart transport wheels 6 on spaced-apart shafts 7. Each shaft 7 is journalled in a pair of fork-shaped brackets 8 projecting outwardly from the sides of the long leg 4*a* of the yoke 4. The two shafts 7 are drivably connected to a power transmission means 10 which is coupled to a drive motor 11. The yoke 4 is also provided with two guide rollers 12, each of which is supported by a bracket 13 so that it freely turns about a vertical axis. The brackets 13 are positioned so that the guide rollers 12 bear against the edge surface of the sheet 1.

Figure 4:
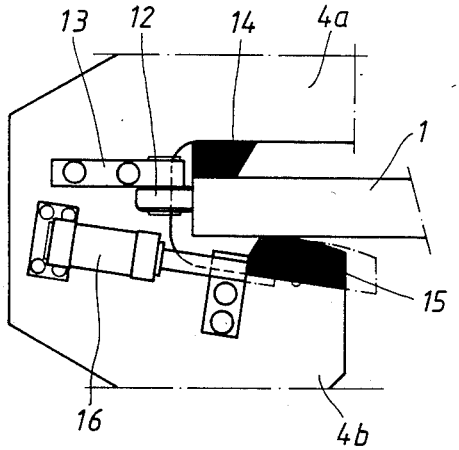
FIG. 4 is an enlarged partial view of part of the yoke of the tool of FIGS. 1 to 3, with an edge guide roller and means to vary the spacing apart of the sheet-engaging pads of the tool.

An upper sheet-engaging pad or bar 14 is connected to the long leg portion 4*a* to extend perpendicularly to the imaginary central plane X and into the recess 5, and a lower sheet-engaging pad or bar 15 is connected to the short leg portion to extend into the recess 5. The lower bar 15 is placed at a greater distance from the interconnecting base portion 4*c* than the upper bar 14, thus obtaining a moment arm L (see FIG. 2) necessary for controlled bending of the edge region of the sheet 1. The lower bar 15 may be displaceably mounted on the yoke 4, as shown in FIG. 4, by means of a pair of operating cylinders 16, one mounted on each side of the yoke 4. The bar 15 may be displaceable between the position shown by full lines in FIG. 4 and the position indicated by dash-dotted lines, whereby the length of the moment arm L may be varied as required.

The operating surfaces of both the pads or bars 14, 15 which face away from the leg portion to which they are connected and which contact the sheet 1, may be shaped to correspond to the desired radius of curvature of the edge region of the sheet, thus the upper bar 14 may be cylindrically concave and the lower bar may be cylindrically convex. The pads or bars 14, 15 are preferably replaceable to optimize the performance of the tool for different sheet thicknesses, different sheet materials and/or different final radii of curvature. The pads or bars 14, 15 are suitably slightly chamfered at their longitudinal ends so that no marks are left in the sheet by the ends of the pads or bars.

In the leg 4*a* of the yoke 4, mutually perpendicular openings 17 and 18 are formed. Cross heads 20 are mounted to run in the openings 18 and a hydraulic tilting cylinder 21 is pivotally journalled in the cross heads 20 by trunnions 22. A piston rod 23 extending from the cylinder 21 is downwardly-directed and is adapted to bear against the sheet 1 during operation of the edge bending tool 3.

The tool 3 is employed as follows: It is placed on the sheet 1 so as to straddle the projecting sheet edge and is moved along the sheet edge to the required starting position. The cylinder 21 is then pressurized, the piston rod 23 thus being pressed down against the upper surface of the sheet 1, whereby the tool 3 is made to tilt from the starting position shown in FIG. 2 to the position shown in FIG. 3. The edge region of the sheet 1 within the recess 5 of the yoke 4 is thereby bent to the desired radius. The bending would typically be started at one end of the sheet 1 and be carried out successively along the entire sheet edge by step-by-step displacement of the tool 3 along the sheet edge, as is indicated by the dash-dotted lines in FIG. 1 which show a previous position of the tool and a later position of the tool. The displacements shown in FIG. 1, being less than the width of the yoke 4, mean that the individual pressure operations partially overlap each other. A lateral displacement of the tool between pressings corresponding to 60–90% of the width of the yoke 4 would be typical. A plurality of bending operations with a moment arm L of different length may be carried out.

As will be clear from the drawings and from the description, the tool 3 is easily transportable and may in many cases effectively replace large, expensive, stationary prior art press plant.

Various modifications may be made to the tool illustrated without departing from the scope of the following claims and all such modifications are intended to be within the ambit of this invention.

What is claimed is:

1. A bending tool for bending an edge portion of a deformable sheet when the deformable sheet is positioned on a support such that the edge portion to be bent projects away from the support, said bending tool comprising:

a generally J-shaped yoke which includes a long leg portion, a short leg portion and an interconnecting base portion, the long leg portion, the interconnecting base portion and the short leg portion providing a recess therebetween, an imaginary central plane extending through said long leg portion in its elongated dimension, a first sheet-engaging bar connected to said long leg portion to extend generally perpendicularly with respect to said imaginary central plane and into said recess, said first sheet-engaging bar having an operating surface facing away from said long leg portion, a second sheet-engaging bar connected to said short leg portion so as to extend into said recess, said second sheet-engaging bar having an operating surface facing away from said short leg portion, said first sheet-engaging bar being located in said recess closer to said connecting base portion than said second sheet-engaging bar, the operating surfaces of said first and second sheet-engaging bars being spaced apart a sufficient distance to enable the edge portion of the deformable sheet, which is generally aligned with said imaginary central plane, to fit therebetween, an extensible force-generating member attached to said long leg portion at a location further from said connecting base portion than said second sheet-engaging bar, said extensible force-generating member being capable, when said bending tool is positioned to operate on a deformable sheet and an edge portion of the deformable sheet is positioned between the operating surfaces of said first and second sheet-engaging bars, of applying a force to the deformable sheet to cause said generally J-shaped yoke to tilt around the edge portion of the deformable sheet and enable said first and second sheet-engaging bars to bend the edge portion of the deformable sheet therebetween.

2. A bending tool according to claim 1, wherein said second sheet-engaging bar is adjustably connected to said short leg portion, and wherein said bending tool includes means for moving said second sheet-engaging bar within said recess toward and away from said interconnecting base portion.

3. A bending tool according to claim 1, including a plurality of transport wheels connected to said long leg portion to movably support said long leg portion on a deformable sheet whose edge portion is positioned between the operating surfaces of said first and second sheet-engaging bars, said transport wheels being connected to said long leg portion such that their axes extend in parallel with the elongated dimension of said long leg portion.

4. A bending tool according to claim 3, including a drive mechanism connected to said transport wheels to cause them to move the bending tool along the deformable sheet as successive edge portions thereof are bent.

5. A bending tool according to claim 1, including a plurality of guide rollers connected to said interconnecting base portion to run along the edge portion of the deformable sheet when said edge portion is positioned between the operating surfaces of said first and second sheet-engaging bars, said guide rollers being connected to said interconnecting base portion such that their axes extend perpendicularly to the elongated dimensions of said long leg portion.

6. A bending tool according to claim 1, wherein the operating surface of one of said first and second sheet-engaging bars has a cylindrical convex curvature and the operating surface of the other of said first and second sheet-engaging bars has a cylindrical concave curvature.

7. A method of curving an edge portion of a deformable sheet, which method comprises placing the sheet on a support so that said edge portion thereof projects beyond the support, locating a J-shaped yoke having an opening defined between one longer and one shorter leg on the projecting edge portion of the sheet in such a way that said edge portion is located within said opening, and extending an extensible drive device connected to the longer leg and pressed against the sheet so that the yoke is tilted relative to the support and the said edge portion is curved as the yoke tilts.

8. A method according to claim 7, in which an elongated bar is located on each leg of the yoke within the opening, and including the step of engaging the sheet by the bars above and below at different distances from the sheet edge.

9. A method as claimed in claim 7, including the step of moving the yoke step-by-step along the edge portion of the sheet until the full length of the edge portion has been traversed and given a first degree of bending, and then traversing again step-by-step to increase the degree of bending.

10. A method as claimed in claim 7, including the step of moving the yoke step-by-step along the edge portion of the sheet until the full length of the edge portion has been traversed, and imparting a degree of bending to the sheet edge within the opening of the yoke, each step advance of the yoke being between 60 and 90% of the width of the yoke measured in the direction of the edge being bent.

* * * * *